United States Patent [19]

Miniere

[11] 4,097,044

[45] Jun. 27, 1978

[54] BASEBALL BATTING TRAINING APPARATUS

[76] Inventor: Jack K. Miniere, 685 Minnesota Ave., Winter Park, Fla. 32789

[21] Appl. No.: 745,062

[22] Filed: Nov. 26, 1976

[51] Int. Cl.[2] ..... A63B 69/40

[52] U.S. Cl. ..... 273/26 R

[58] Field of Search ..... 273/26 R, 26 A, 26 E, 273/1 B, 35 R, 185 D, 186 R, 197 R, 29 A, 181 J, 100 B, 202, 81.3; 272/83

[56] References Cited

U.S. PATENT DOCUMENTS

| | | | |
|---|---|---|---|
| 649,190 | 5/1900 | Zimmerman | 273/200 B |
| 2,818,255 | 12/1957 | Ponza | 273/26 R |
| 3,341,200 | 9/1967 | Brandley | 273/95 A |
| 3,794,320 | 2/1974 | Salmont | 273/26 R |

FOREIGN PATENT DOCUMENTS

| | | | |
|---|---|---|---|
| 725,556 | 2/1932 | France | 273/200 B |

*Primary Examiner*—Richard C. Pinkham
*Assistant Examiner*—T. Brown
*Attorney, Agent, or Firm*—Duckworth, Hobby & Allen

[57] ABSTRACT

A batting training device designed and constructed whereby a movable target is automatically positioned for batting practice after each blow delivered with a baseball bat.

7 Claims, 5 Drawing Figures

FIG 1
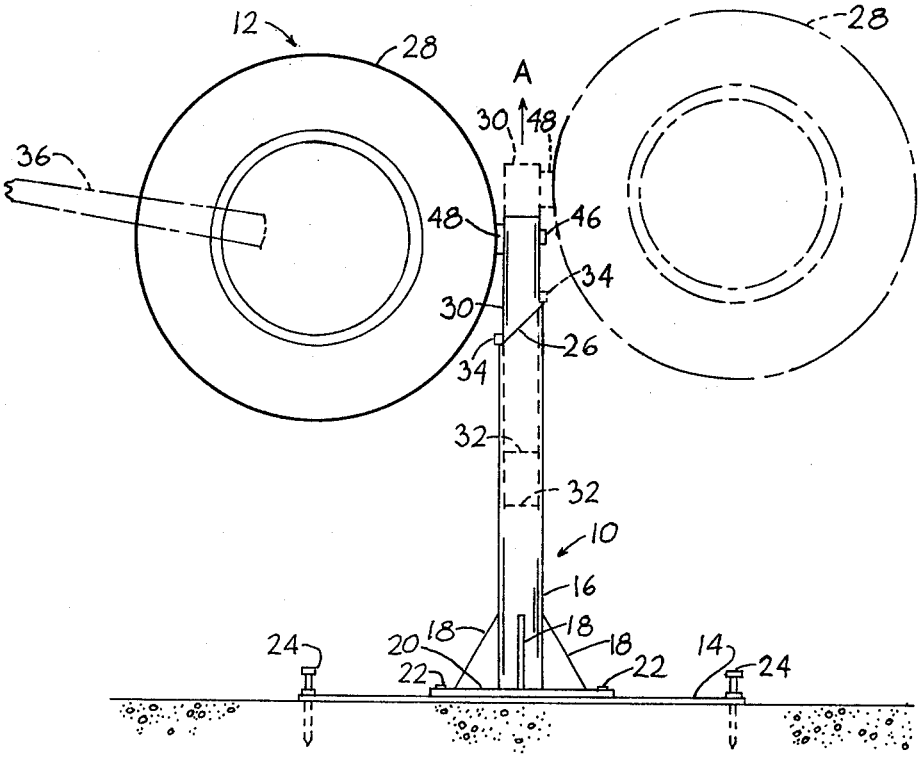
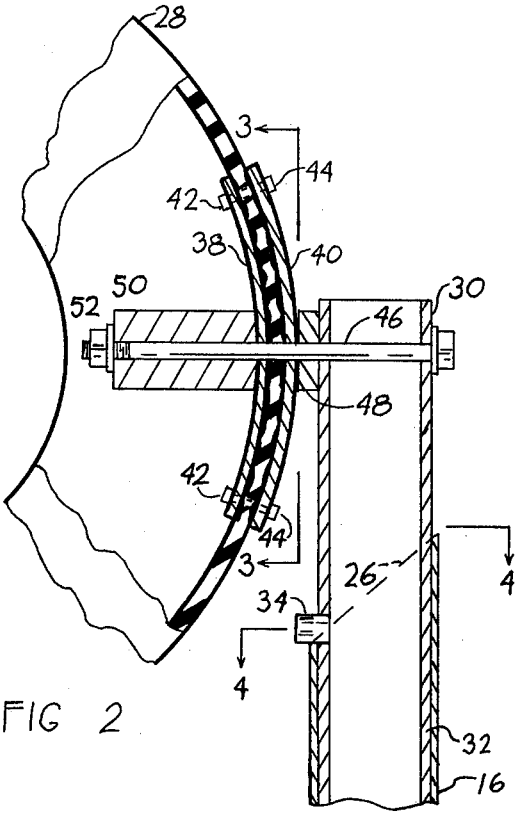
FIG 2
FIG 3
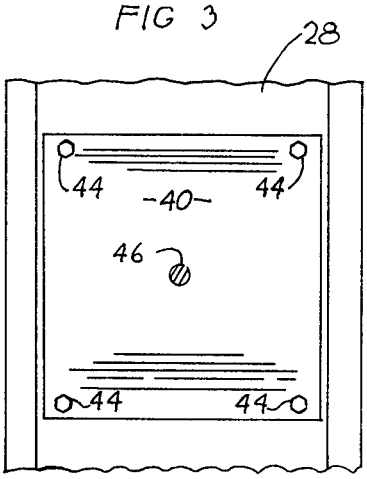
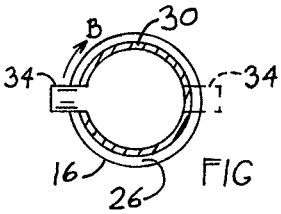
FIG 4

BASEBALL BATTING TRAINING APPARATUS

BACKGROUND OF THE INVENTION

1. Field of the Invention

The present invention relates to a batting training device including a movable target disposed on a support, said target being disposed for contact with a baseball bat. The device is constructed so that the target will automatically return to the "ready" position regardless of the force with which it is struck.

2. Description of the Prior Art

While the status of baseball as the national passtime for citizens of the United States might be subject to question today, there can be no question that very few sports require the skill and coordination called for in striking a small, spherical object with a bat as that object approaches you at speeds often in excess of 90 miles per hour. In recognition of the skill and coordination necessary to successfully strike a baseball, numerous prior art devices have been constructed for the purpose of coaching and developing skills necessary to hit a baseball. Such devices range in function and complexity from automatic pitching machines to relatively simple pedestal constructions upon which a ball is placed prior to being hit.

One such training device is disclosed in U.S. Pat. No. 3,271,030, and comprises an arm rotably mounted on a support standard. Affixed to the end of the arm is a baseball-like object which can be struck by a batter. Striking the ball causes the arm to rotate around the standard. U.S. Pat. No. 3,914,557, discloses a practice device wherein a ball may be suspended at predetermined heights from a string or cord. The ball is then hit, but does not have to be retrieved because of its tethered construction. Yet another batting practice device is disclosed in U.S. Pat. No. 2,818,255. That patent also discloses a structure comprising a standard having an arm rotatably mounted thereon. A simulated baseball is mounted at the free end of the arm and rotates around the axis of the standard when struck by a bat. This device is particularly noteworthy, for it includes a biasing element whereby the resistance of the simulated baseball to the bat may be varied, and whereby the ball will be returned to its initial position after each "hit".

As indicated above, numerous other types of batting training devices are known in the prior art. However numerous problems associated with such devices remain unsolved. For example, in those devices utilizing a tethered ball simulator, after each hit the ball must be manually repositioned for each subsequent training stroke. While the device referred to in U.S. Pat. No. 2,818,255, above, automatically repositions the ball simulator, the structure utilized to accomplish this result is relatively complex. Of course, the more complex a device is the greater the skills are required to properly utilize and maintain that device. Furthermore, it cannot be ignored tht such devices are expensive, thereby inherently limiting their availability to that class of ball player which might be termed "professional."

Accordingly, it is apparent that there is a great need in the art for a batting training device which might be just as easily used by Little Leaguers as well as by major league professionals. Such a batting training device should be of simple construction so as to be easily assembled and maintained in working order. Of course, by virtue of a simple construction, the preferred batting training device would be relatively inexpensive. However, the device must be constructed so as to provide a realistic training environment. Finally, it would be desirable if the device were constructed so that the area intended for striking with the baseball bat would automatically reposition itself for the next hit subsequent to each practice swing.

SUMMARY OF THE INVENTION

The present invention relates to a batting training device including a target means movably disposed on a support means, whereby the target means may be repeatedly struck during the coaching of proper batting techniques. More specifically, the target means of the present invention preferably comprises an automobile tire casing. It has been determined that such a target not only provides a realistic "feel" when struck by the baseball bat, but also significantly reduces the overall cost of the device.

The target means comprising an automobile tire casing is removably, fixedly attached to a pivot means which is movably mounted on a support means such that the target is disposed above the supporting surface in the vicinity of the batter's strike zone.

It should be obvious that the automobile tire casing is removably attached to the pivot means so that the casing may be removed for transporting or storing the device, and so that the casing may be replaced when necessary.

The pivot arm of the target means comprises a substantially tubular member, one end of which defines a leg portion which is movably disposed within the device support means. To accomplish this construction, the device support means preferably comprises a support base and a pedestal, one end of which is fixedly attached to the base in substantially perpendicular relation thereto. The pedestal is formed from a hollow cylindrical material, and the leg portion of the pivot arm slips, or sleeves, into the open, top end of the pedestal. Accordingly, the pivot arm is free to rotate within the pedestal.

Additionally, the batting training device of this invention includes structural elements whereby the contact element of the target means will automatically return to its original position in the vicinity of the batter's strike zone subsequent to being struck with the baseball bat. To accomplish this the upper end of the device pedestal is formed to define an acute angle with respect to the plane of the device base. A finger extends radially from the top of the device leg portion and engages the cam means. Therefore, when the contact element is struck causing the pivot means to rotate within the pedestal, the finger will ride on the cam means. The lowest portion of the cam means is substantially on the plane defined by the contact element, so that the contact element will eventually come to rest, by virtue of gravitational forces, in a virtually identical position after each practice swing.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which:

FIG. 1 is an elevational view of the invention showing its movement in broken lines.

FIG. 2 is a detail, sectional view illustrating the attachment of the contact element to the pivot arm and the movable disposition of the pivot arm in the support pedestal.

FIG. 3 is a detail view taken along line 3—3 of FIG. 2.

FIG. 4 is a sectional view taken along line 4—4 of FIG. 2.

Similar reference characters refer to similar parts throughout the several views of the drawings.

DETAILED DESCRIPTION

Figure 5:
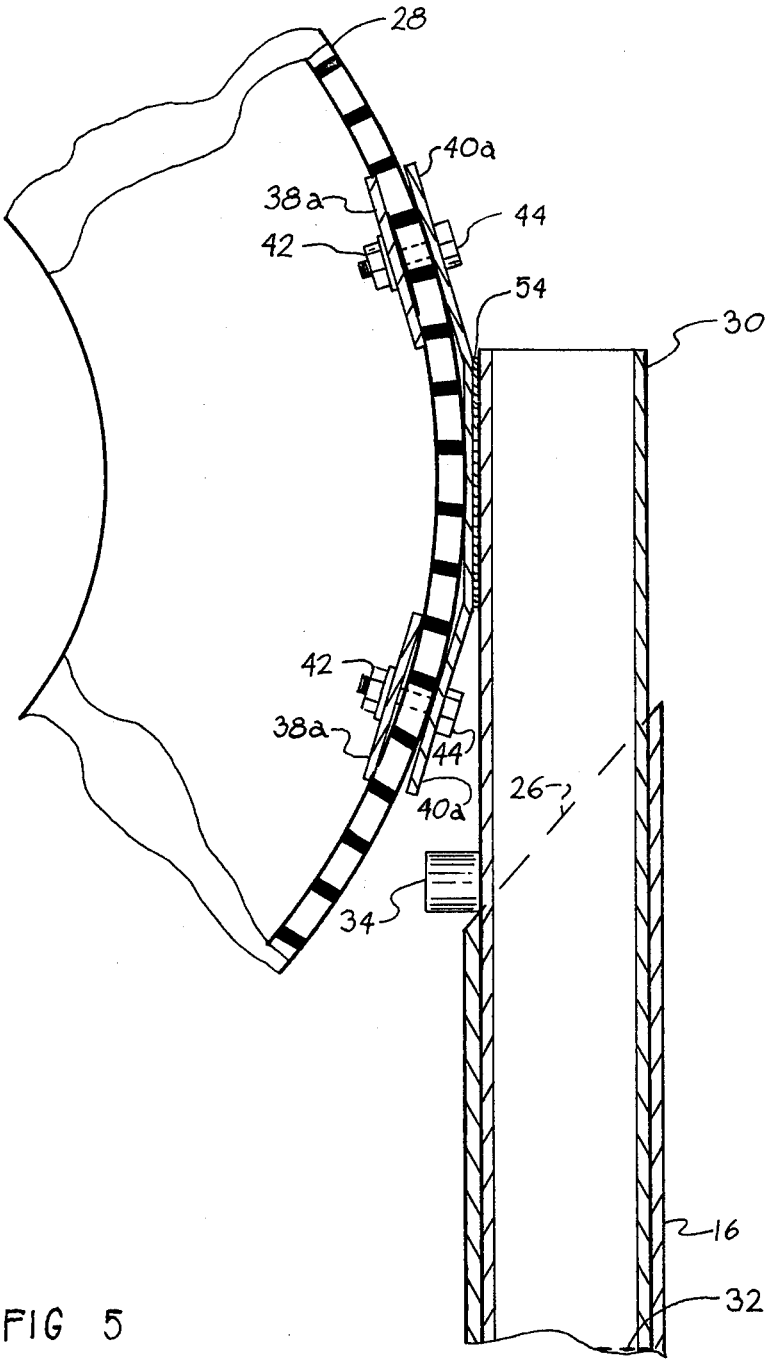
FIG. 5 is a detail, sectional view similar to that of FIG. 2 showing a second embodiment for the attachment means.

A preferred embodiment of the batting training device of the present invention is shown in the view of FIG. 1. As indicated therein, the device comprises support means generally indicated as 10 and target means generally indicated as 12 movably disposed on support means 10. Support means 10 further comprises a base 14 and a pedestal 16. One end of pedestal 16 is fixedly attached to base 14 in substantially perpendicular relation thereto. As shown in the embodiment of FIG. 1, this fixed, substantially perpendicular attachment may be accomplished as by flanges 18, pedestal plate 20, and suitable fastening means such as bolts 22. The support means is then positioned and held on the supporting surface as by anchors 24. As will be set forth in greater detail below, support means 10 further comprises cam means 26 formed on the top end of pedestal 16 in movement-regulating relation to target means 12.

As shown in the preferred embodiment of FIG. 1, target means 12 comprises a contact element defined by automobile tire casing 28. Target means 12 further comprises pivot means 30 to which casing 28 is fixedly, removably attached. A leg portion 32 of pivot means 30 is inserted into the hollow cylinder defined by pedestal 16. A finger 34 extends radially from the top of leg portion 32 and engages cam means 26 defining the top of pedestal 16.

As indicated in phantom in the view of FIG. 1, when casing 28 is struck by bat 36, target means 12 will rotate within support means 10 and, because of the interaction between finger 34 and cam means 26, will rise in the direction indicated by arrow A. The apex of this rise is indicated in phantom in FIG. 1. Depending upon the energy imparted to target means 12 when it is struck by bat 36, target means 12 may complete less than one or a plurality of revolutions around the axis of pedestal 16. In any event, target means 12 will eventually come to rest in the initial starting position indicated by solid lines in the view of FIG. 1. The pivoting, rotary motion of target means 12 around the axis of pedestal 16 is indicated by arrow B in the sectional view of FIG. 4.

The sectional view of FIG. 2 illustrates a structure for attaching tire casing 28 to pivot means 30. As shown therein, the preferred attachment means comprises plate means including a first plate 38 and a second plate 40. First plate 38 is disposed on the interior of casing 28, and second plate 40 is correspondingly disposed on the outside of casing 28. First plate 38 and second plate 40 are attached to each other by any suitable fastening means such as, for example, nuts and bolts 42 and 44, respectively.

Corresponding apertures are formed in first plate 38, casing 28, second plate 40 and pivot means 30, and a fastening means 46 extends therethrough in interlocking relation between casing 28 and pivot means 30.

In order to dampen undesirable vibration when target means 12 is struck, attachment means further includes shock absorber means comprising a resilient washer 48 disposed around fastening means 46 in abutting relation between second plate 40 and pivot means 30. The shock absorber means may further comprise a second washer 50 similarly disposed around fastening means 46 in abutting relation between first plate 38 and end 52 of fastening means 46.

By virtue of this construction, casing 28 may be conveniently removed from pivot means 30 as for storage or transportation simply by removing fastening means 46. Furthermore, casing 28 can be replaced, when necessary, simply by removing first plate 38 and second plate 40 and attaching them to another casing.

Alternatively, as shown in the detail view of FIG. 5, the attachment means may comprise plate means including two first plates **38*a* and a second plate 40*a*. First plates 38*a* are disposed on the interior of casing 28, and second plate 40*a* is correspondingly disposed on the outside of casing 28. First plates 38*a* and second plate 40*a* are attached to each other by any suitable fastening means such as, for example, nuts and bolts 42 and 44**, respectively.

Target means 12 of this embodiment is then fixedly disposed on pivot means 30 by welding second plate **40*a* to pivot means 30 as indicated at weld 54**.

It will thus be seen that the objects set forth above, among those made apparent from the preceding description, are efficiently attained, and since certain changes may be made in the above construction without departing from the scope of the invention it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A batting training device comprising: support means for operatively positioning said device above a support surface; target means rotably disposed on said support means and positioned to receive the impact of a bat swung into contact therewith, said support means including cam means formed thereon to guide the movement of said target means whereby said target means will assume a substantially identical stationary position after each impact of said target means by said bat, and wherein said target means comprises a contact element disposed to receive the impact of said bat and pivot means fixedly attached to said contact element, said pivot means including guide means formed thereon in engaging relation to said cam means; and attachment means disposed in fixed, interconnecting relation between said contact element and said pivot means and comprising plate means for supporting said contact element to said pivot means and being attached to said contact element, said plate means and said contact element including correspondingly positioned apertures formed therethrough, and fastening means extending through said apertures, one end of said fastening means being attached to said pivot means.

2. A batting training device as in claim 1 wherein said support means comprises a base and a pedestal, one end of said pedestal being fixedly attached to said base in substantially perpendicular relation thereto, said pedestal comprising a hollow cylinder.

3. A batting training device as in claim 2 wherein the other end of said cylinder is formed to define an acute angle with respect to said base, said other end comprising said cam means.

4. A batting training device as in claim 3 wherein said pivot means comprises a leg portion dimensioned and configured to be inserted into said other end of said cylinder defining said cam means.

5. A batting training device as in claim 4 wherein said guide means comprises a finger extending radially from the top of said leg portion, whereby said finger will ride on said cam means when said pivot means is rotated.

6. A batting training device as in claim 1 wherein said contact element comprises a tire casing and wherein said plate means comprises a first plate disposed on the inside of said casing and a second plate correspondingly positioned on the exterior of said casing, said first and second plates being attached through said casing to each other.

7. A batting training device as in claim 6 wherein said attachement means further comprises shock absorber means disposed around said fastening means between said second plate and said pivot means, portions of said shock absorber means abutting said second plate and said pivot means.

* * * * *